US005906368A

United States Patent [19]

Hamers et al.

[11] Patent Number: 5,906,368

[45] Date of Patent: May 25, 1999

[54] DRIVE MECHANISM FOR A GRIPPER MECHANISM ARRANGED IN A DRIVABLE DRUM FOR FEEDING SEPARATE PRODUCTS

[75] Inventors: Ludovicus Wilhelmus Alphonsus Hamers, Westzaan; Petrus Franciscus Kivits, Schiedam, both of Netherlands

[73] Assignee: Buhrs-Zaandam B.V., Zaandam, Netherlands

[21] Appl. No.: 08/562,568

[22] Filed: Nov. 24, 1995

[30] Foreign Application Priority Data

Nov. 25, 1994 [NL] Netherlands ..... 9401986

[51] Int. Cl.[6] ..... B65H 5/02

[52] U.S. Cl. ..... 271/277; 271/82; 101/410

[58] Field of Search ..... 271/275, 277, 271/82, 314; 101/246, 409, 410, 411

[56] References Cited

U.S. PATENT DOCUMENTS

| | | | |
|---|---|---|---|
| 3,810,612 | 5/1974 | McCahon et al. . | |
| 4,120,263 | 10/1978 | Boschet | 271/277 X |
| 4,732,374 | 3/1988 | Honegger | 271/277 X |
| 4,905,985 | 3/1990 | Nagatani | 271/82 X |
| 5,362,043 | 11/1994 | Grellman | 101/409 X |

FOREIGN PATENT DOCUMENTS

| | | | |
|---|---|---|---|
| 39 35 372 | 4/1991 | Germany . | |
| 192046 | 8/1991 | Japan | 271/275 |
| 2060579 | 5/1981 | United Kingdom . | |
| 2139196 | 11/1984 | United Kingdom . | |

*Primary Examiner*—Boris Milef

*Attorney, Agent, or Firm*—Griffin, Butler, Whisenhunt & Szipl, LLP

[57] ABSTRACT

A drive for a gripper mechanism of a feeding device for feeding separate products, for instance loose sheets, to a packaging or labelling machine, which gripper mechanism is arranged on a drivable drum (1) and comprises gripper elements (2) for gripping the products to be fed separately, wherein the drive of the gripper elements (2) comprises a toothed belt transmission (3, 4, 5), with the gripper elements (2) being connected to the driven pulley (3), and the driving pulley (5) being drivable by a double cam mechanism (6, 6', 7, 7', 8, 9).

6 Claims, 2 Drawing Sheets

DRIVE MECHANISM FOR A GRIPPER MECHANISM ARRANGED IN A DRIVABLE DRUM FOR FEEDING SEPARATE PRODUCTS

This invention relates to a drive for a gripper mechanism of a feeding device for feeding separate products, for instance loose sheets, to a packaging or labelling machine, which gripper mechanism is arranged on a drivable drum and comprises gripper elements for gripping the products to be fed separately.

BACKGROUND OF THE INVENTION

Such a drive for a gripper mechanism is disclosed in U.S. Pat. No. 3,810,612. There the gripper elements are attached to one end of a two-armed lever. The other end of the lever is provided with a toothing cooperating with a gear segment of a second lever. This second lever is actuated by a cam mechanism, so that the gripper element is pivotally reciprocated through a certain angle.

A disadvantage of this drive of the gripper mechanism is that the toothing requires lubrication. In addition, the toothing is subject to wear, which causes play in the drive. Moreover, replacing such levers having a gear segment is rather costly.

The object of the invention is to provided a drive that does not have the above-mentioned disadvantages.

SUMMARY OF THE INVENTION

To that end, the drive according to the invention is characterized in that the drive of the gripper elements comprises a toothed belt transmission, with the gripper elements being connected to a driven pulley, and a driving pulley being drivable by a double cam mechanism. As a consequence, the drive no longer needs lubricating and moreover a transmission by means of a toothed belt is free from play. In addition, such a transmission produces less noise and is subject to less wear.

Preferably, the drive is so designed that the driven pulley of the toothed belt transmission comprises a switching element pivotable about the driven pulley, this switching element comprising two bypass rollers which enlarge the arc embraced by the toothed belt around the driven pulley. The driving pulley is drivable by the cam mechanism, and via the toothed belt the driven pulley is forced to perform an angular displacement. When the gripper elements strike the product to be drawn in, or strike the drum in the absence of a product, the driven pulley cannot rotate any further. If, due to an imperfect setting of the cam mechanism, the driving pulley rotates slightly further, it should be possible for the length of the driving part of the toothed belt to be reduced and the length of the driven or slack part to be increased commensurately. This is realized by means of the switching element adapted to pivot about the driven pulley. The bypass roller abutting the driving part of the toothed belt is rotated about the driven pulley, against the direction of rotation of the pulley, so that the length of the driving part of the toothed belt between the pulleys decreases. Simultaneously, the bypass roller abutting the slack part of the toothed belt moves in the same direction, so that the length of the slack part is increased to the same extent.

A particularly advantageous embodiment of the drive according to the invention is achieved in that the bypass roller abutting the slack part of the toothed belt is arranged on a separate switching element capable of performing a small angular displacement relative to the main switching element. This separate pivotable switching element prevents the tensile stress in the toothed belt form increasing and thus the life of the toothed belt is extended.

Preferably, the drive is further designed in such a manner that the gripper elements are pressed against the drum by means of a compression spring engaging the main switching element. The compression spring pushes against the main switching element, so that a tensile force is introduced into the driving part of the toothed belt by the bypass roller abutting this part. This tensile force results in a couple on the driven pulley at the instant when the gripper elements, connected to the driven pulley, strike the product. The force with which a product is clamped between the gripper elements and the drum is a resultant of that couple.

By making the force of the compression spring adjustable, adjustability of the clamping force is achieved. In this way, an optimum clamping force can be set for each kind of product, that is, a clamping force which is as slight as possible, yet sufficiently great to draw in a product without the product being damaged by an unduly high clamping force.

A particularly suitable manner of constructing the drive for the gripper mechanism is characterized in that the cam mechanism is a double design, with the cam roller on one lever being drivable by an inner cam and the cam roller on the other lever being drivable by an out cam. Because both levers are mounted on the same shaft and one cam roller follows an inner cam while the other cam roller follows an outer cam, the cam rollers are prevented from coming clear of a cam, and thus the cam mechanism is substantially free from play. As a result, wear and extra high impact loads are avoided. The levers of the cam mechanism are mounted on the shaft of the driving pulley, which, as a consequence, performs a fixed, prescribed angular displacement. This angular displacement is transmitted via the toothed belt and the driven pulley to the gripper elements.

A particularly good result is obtained if the shaft on which the driving pulley and the levers of the cam mechanisms are arranged, is mounted under a bias. As a result, the cam mechanism is entirely free from play and thus the entire drive of the gripper elements is of a design free from play.

The invention further relates to a feeding device for feeding separate products, for instance loose sheets, to a packaging or labelling machine, comprising a chassis with a table for supporting a stack of products to be fed, a rotatable drum with a drive shaft, which is rotatably supported by the chassis, a gripper mechanism mounted on the drum and including gripper elements for gripping the products, suction cup elements for withdrawing a separate product from the bottom of a stack and transferring that product to the gripper elements, wherein the feeding device comprises a drive for the gripper mechanism according to the invention.

BRIEF DESCRIPTION OF THE DRAWINGS

An embodiment of the drive according to the invention is further explained below with reference to the drawings, wherein.

DETAILED DESCRIPTION OF THE PREFERRED EMBODIMENTS

Figure 1:
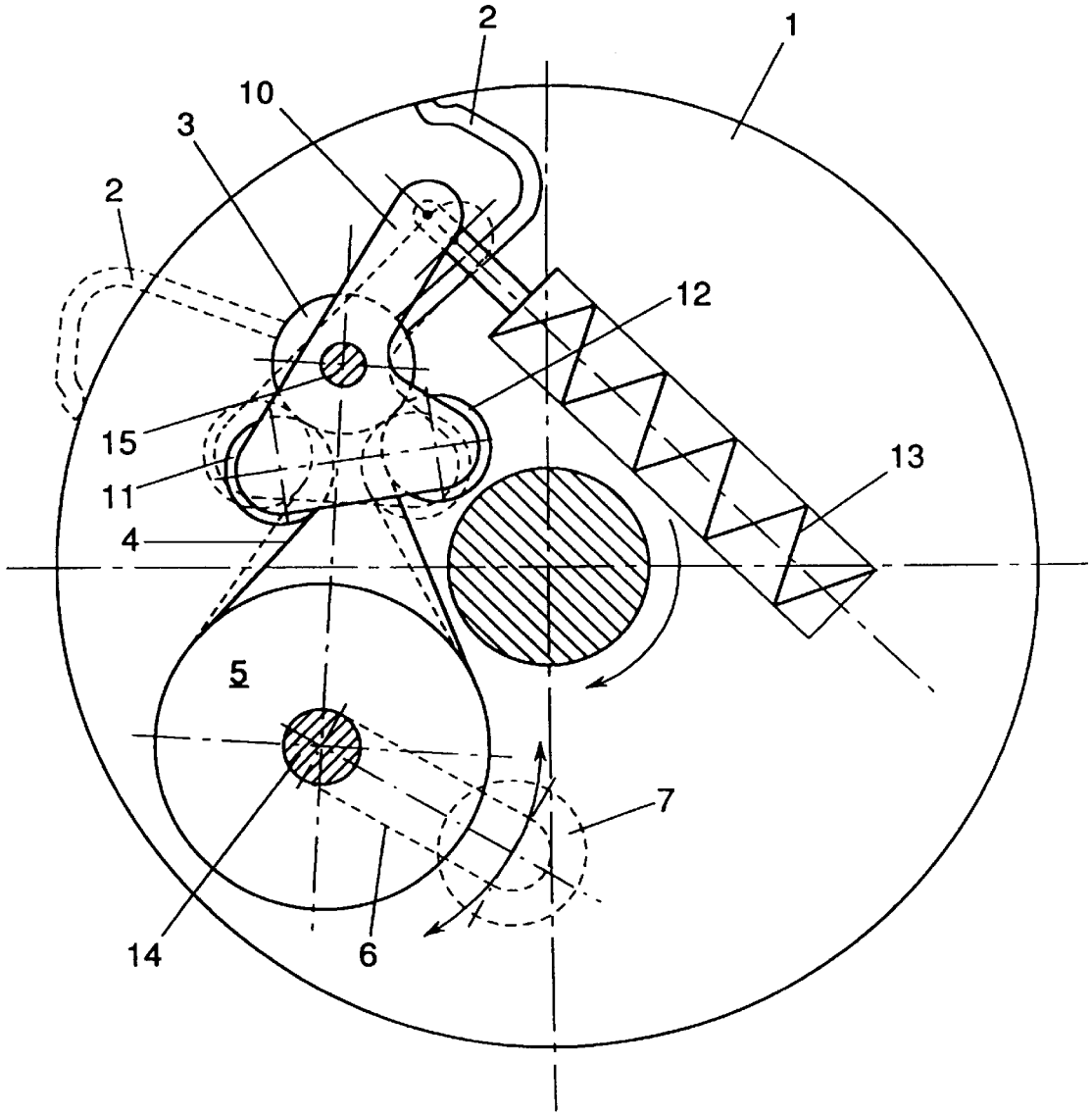
FIG. 1 is a schematic side elevational view of a drive of a gripper mechanism according to the invention.
Figure 2:
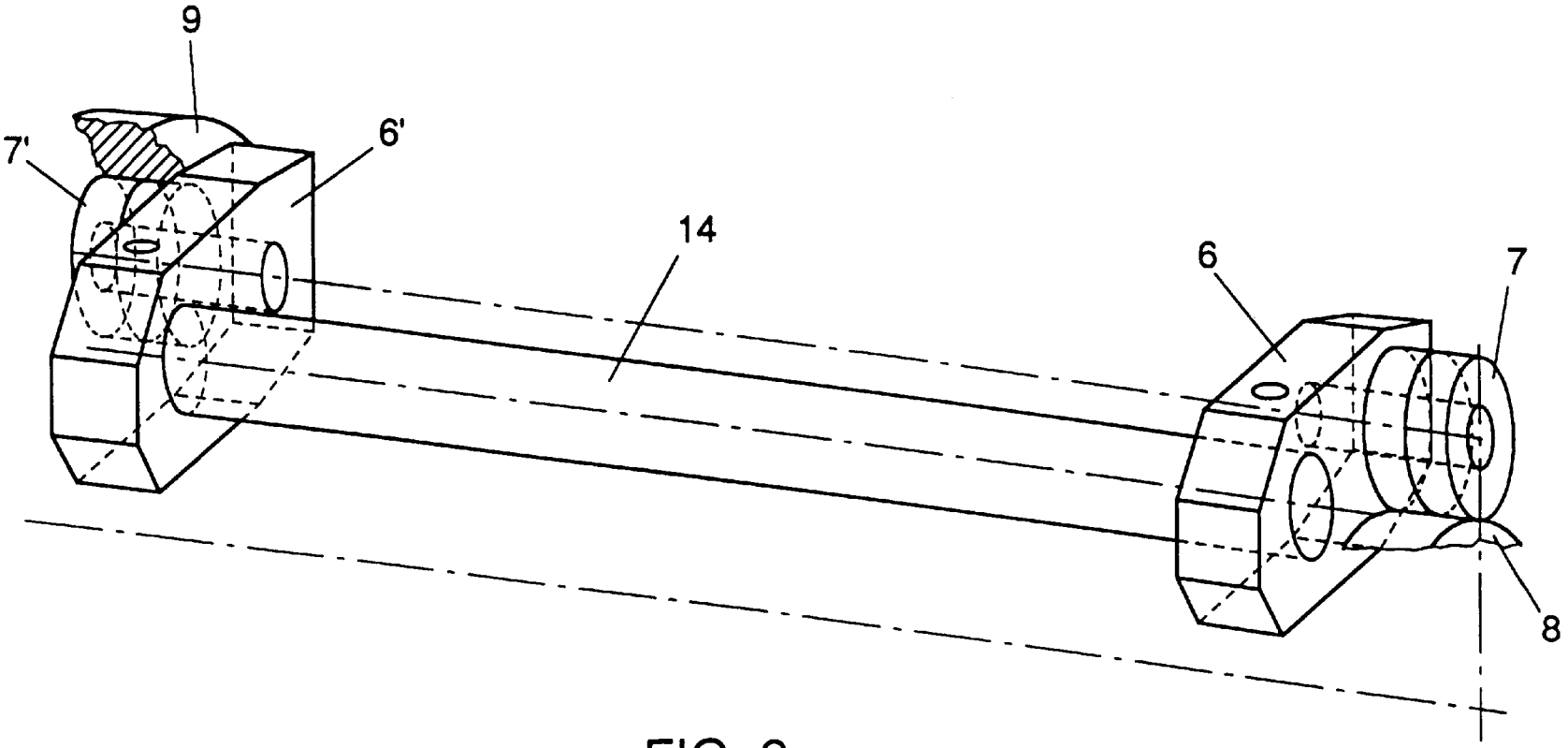
FIG. 2 is a perspective view of a cam mechanism of double design according to the invention.

FIG. 1 shows a drivable drum 1 on which a gripper mechanism is mounted. The gripper elements 2 are fixedly mounted on a driven pulley 3. A toothed belt 4 passes over the driven pulley 3 to a driving pulley 5. Mounted on the shaft 14 of the driving pulley 5 is a double cam mechanism (see FIG. 2). This cam mechanism is constituted by two levers 6, 6' which at the free ends thereof are provided with a cam roller 7, 7'. These cam rollers 7, 7' are actuated by an inner cam 8 and an outer cam 9, respectively.

Arranged on the driven pulley 3 is a switching element 10, adapted to pivot about the same shaft 15 as that of the driven pulley 3. The switching element 10 comprises two bypass rollers 11, 12. These bypass rollers 11, 12 are mounted on the switching element 10 so as to enlarge the arc embraced by the toothed belt 4 around the driven pulley 3.

The driving pulley 5 is driven by the cam mechanism, and via the toothed belt 4 the driven pulley 3 is forced to perform an angular displacement. When the gripper elements 2 strike the product to be withdrawn, or strike the drum 1 in the absence of a product, the driven pulley 3 cannot rotate any further. If, due to an imperfect setting of the cam mechanism, the driving pulley 5 rotates slightly further, it should be possible for the length of the driving part of the toothed belt 4 to be reduced and for the length of the driven or slack part to be increased to the same extent. This is realized by means of the switching element 10 adapted to pivot about the driven pulley 3. The bypass roller 11 abutting the driving part of the toothed belt 4 is rotated about the driven pulley 3, against the direction of rotation of the pulley 3, so that the length of the driving part of the toothed belt 4 between the pulleys 3, 5 decreases. Simultaneously, the bypass roller 12 abutting the slack part of the toothed belt 4 moves in the same direction, so that the length of the slack part is increased to the same extent.

A particularly advantageous embodiment of the drive according to the invention is achieved in that the bypass roller 12 abutting the slack part of the toothed belt 4 is arranged on a separate switching element (not shown), adapted to perform a small angular displacement relative to the main switching element 10. This pivotable separate switching element prevents the tensile stress in the toothed belt 4 from increasing and so the life of the toothed belt 4 is extended.

Preferably, the drive is further designed in such a manner that the gripper elements 2 are pressed against the drum 1 by means of a compression spring 13 (shown diagrammatically), which engages the main switching element 10. The compression spring 13 pushes against the main switching element 10, so that a tensile force is introduced into the driving part of the toothed belt 4 by the bypass roller 11 abutting this part. This tensile force results in a couple on the driven pulley 3 at the instant when the gripper elements 2, connected to the driven pulley 3, strike the product. The force with which a product is clamped between the gripper element 2 and the drum 1 is a resultant of the couple.

By making the force of the compression spring 13 adjustable, adjustability of the clamping force is achieved. In this way, an optimum clamping force can be set for each kind of product, that is, a clamping force which is as slight as possible, yet sufficiently great to draw in a product without the product being damaged by an unduly high clamping force.

A particularly suitable manner of constructing the drive for the gripper mechanism is characterized in that the cam mechanism is of double design, with the cam roller 7 on one lever 6 being drivable by an inner cam 8 while the cam roller 7' on the other lever 6' is drivable by an outer cam 9. Because the two levers 6, 6' are mounted on the same shaft 14 and one cam roller 7 follows an inner cam 8 while the other cam roller 7' follows an outer cam 9, the cam rollers 7, 7' are prevented from coming clear of a cam 8, 9, and thus the cam mechanism is substantially free from play. As a result, wear and extra high impact loads are avoided. The levers 6, 6' of the cam mechanism are mounted on the shaft 14 of the driving pulley 5, which, as a consequence, has a fixed, prescribed angular displacement. This angular displacement is transmitted via the toothed belt 4 and the driven pulley 3 to the gripper elements 2.

A particularly good result is obtained if the shaft 14 on which the driving pulley 5 and the levers 6, 6' of the cam mechanisms are arranged, is mounted under a bias. As a result, the cam mechanism is entirely free from play and thus the entire drive of the gripper elements 2 is of a design free from play.

The invention further relates to a feeding device for feeding separate products, for instance loose sheets, to a packaging or labelling machine, comprising a chassis with a table for supporting a stack of products to be fed, a rotatable drum with a drive shaft, which is rotatably supported by the chassis, a gripper mechanism mounted on the drum 1 and including gripper elements 2 for gripping the products, suction cup elements for withdrawing a separate product from the bottom of a stack and transferring that product to the gripper elements 2, wherein the feeding device comprises a drive for the gripper mechanism according to the invention.

We claim:

1. In a drive for a gripper mechanism of a feeding device for feeding separate sheet products to a packaging or labeling machine, which gripper mechanism is arranged on a drivable drum and comprises gripper elements for gripping the products to be separately fed, the improved drive comprising:

(1) a toothed belt;

(2) a driven pulley;

(3) a driving pulley mounted on a shaft; and (4) a double cam mechanism comprising:

a first cam follower on a first lever;

a second cam follower on a second lever;

an outer cam cooperating with the first cam follower;

an inner cam cooperating with the second cam follower;

the toothed belt being arranged for cooperation with the driving and the driven pulley, the gripper elements being connected to the driven pulley, the first lever and the second lever being mounted on the shaft on which the driving pulley is mounted, such that a rotational position of the driving pulley and the gripper elements is determined by the double cam mechanism.

2. A drive for a gripper mechanism according to claim 1, further comprising a switching element pivotable about the driven pulley, with the switching element comprising two bypass rollers which enlarge an arc embraced by the toothed belt around the driven pulley.

3. A drive for a gripper mechanism according to claim 2, including a compression spring engaged to the switching element (10) for pressing the gripper elements against the drum.

4. A drive for a gripper mechanism according to claim 3, wherein the force with which the compression spring engages the switching element is adjustable.

5. A drive according to claim 1, wherein the outer and the inner cams and positions of the first and the second lever are such that the shaft is mounted under a bias, so as to prevent play in the rotational position of the driving pulley.

6. A feeding device for feeding separate sheet products to a packaging or labeling machine, the feeding device comprising:

a rotatable drum with a rotatably supported drive shaft; and a gripper mechanism comprising the drive according to claim 1.

* * * * *